US006062878A

United States Patent [19]

Kuo

[11] Patent Number: 6,062,878

[45] Date of Patent: May 16, 2000

[54] IC CARD CONNECTOR

[75] Inventor: Ming-Lun Kuo, Taipei, Taiwan

[73] Assignee: Hon Hai Precision Ind. Co., Ltd., Taipei Hsien, Taiwan

[21] Appl. No.: 09/334,357

[22] Filed: Jun. 16, 1999

[30] Foreign Application Priority Data

Dec. 31, 1998 [TW] Taiwan ..... 87222067

[51] Int. Cl.[7] ..... H01B 12/20

[52] U.S. Cl. ..... 439/79; 439/924.1

[58] Field of Search ..... 439/79, 64, 924.1

[56] References Cited

U.S. PATENT DOCUMENTS 5,434,752 7/1995 Huth et al. ..... 439/924.1
5,591,035 1/1997 Burholder et al. ..... 439/924.1
5,601,438 2/1997 Ho et al. ..... 439/79
5,653,596 8/1997 Banakis et al. ..... 439/64
5,794,336 8/1998 Hopson et al. ..... 439/79

*Primary Examiner*—Gary F. Paumen
*Attorney, Agent, or Firm*—Wei Te Chung

[57] ABSTRACT

An IC card connector includes an insulative housing and two arrays of terminals retained therein. The housing has a mating face and an opposite mounting face. A space is defined adjacent to the mating face for receiving an IC card therein. An elongate spacer extends from the mounting face and defines a number of notches having different predetermined depths. Each terminal forms a mating portion and an opposite mounting portion. The mating portion extends beyond the mating face and into the space for engaging an IC card. The mounting portion forms a solder end which is secured in the notch and soldered to a circuit board using surface mount technology. All the terminals in one array are dimensioned the same. When the mounting portions of the terminals are secured in the notches, the mating portions therefore extend different predetermined lengths beyond the mating face.

4 Claims, 5 Drawing Sheets

IC CARD CONNECTOR

BACKGROUND OF THE INVENTION

The present invention relates to an IC card connector, and particularly to an IC card connector which has a spacer defining a plurality of notches of different depths for securing terminals therein.

When an IC card connector, such as the disclosure of U.S. Pat. No. 5,653,596, engages with an IC card, grounding terminals electrically contact corresponding portions of the IC card before the terminals which provide the function of signal transmission engage the IC card. Therefore, the terminals are manufactured with different lengths which require different molds and carriers. In addition, such a method increases the possibility of overstock.

In assembly, the terminals are bent by a mechanical device to form a mating portion and a mounting portion. However, the mounting portions may not be coplanar thereby complicating the process of soldering the mounting portions to a circuit board.

SUMMARY OF THE INVENTION

Accordingly, an object of the present invention is to provide an IC card connector having a mechanism for determining a protruding length of a mating portion of each terminal extending beyond a housing.

To fulfill the above-mentioned object, an IC card connector comprises an insulative housing and two arrays of terminals retained in the housing. The housing defines a mating face and an opposite mounting face. A space is defined adjacent to the mating face for receiving an IC card therein. An elongate spacer extends from the mounting face and defines a plurality of notches having different predetermined depths. Each terminal extends through the mating face and the mounting face and forms a mating portion and an opposite mounting portion. The mating portion extends beyond the mating face and into the space for engaging an IC card. The mounting portion forms a solder end which is secured in the notch and soldered to a circuit board using surface mount technology. All the terminals in the same array are dimensioned the same, thus, the mating portions extend different predetermined distances beyond the mating face, accordingly. For the requirement of two arrays of upper and lower terminals, only portions of a mold need to be changed. Thus, one mold with one type of carrier is adapted to manufacture terminals of the same length and different heights. Finally, a middle portion between the mating portion and the mounting of each terminal is transversely bent to align the mounting portion with the corresponding notch.

DETAILED DESCRIPTION OF THE INVENTION

Figure 1:
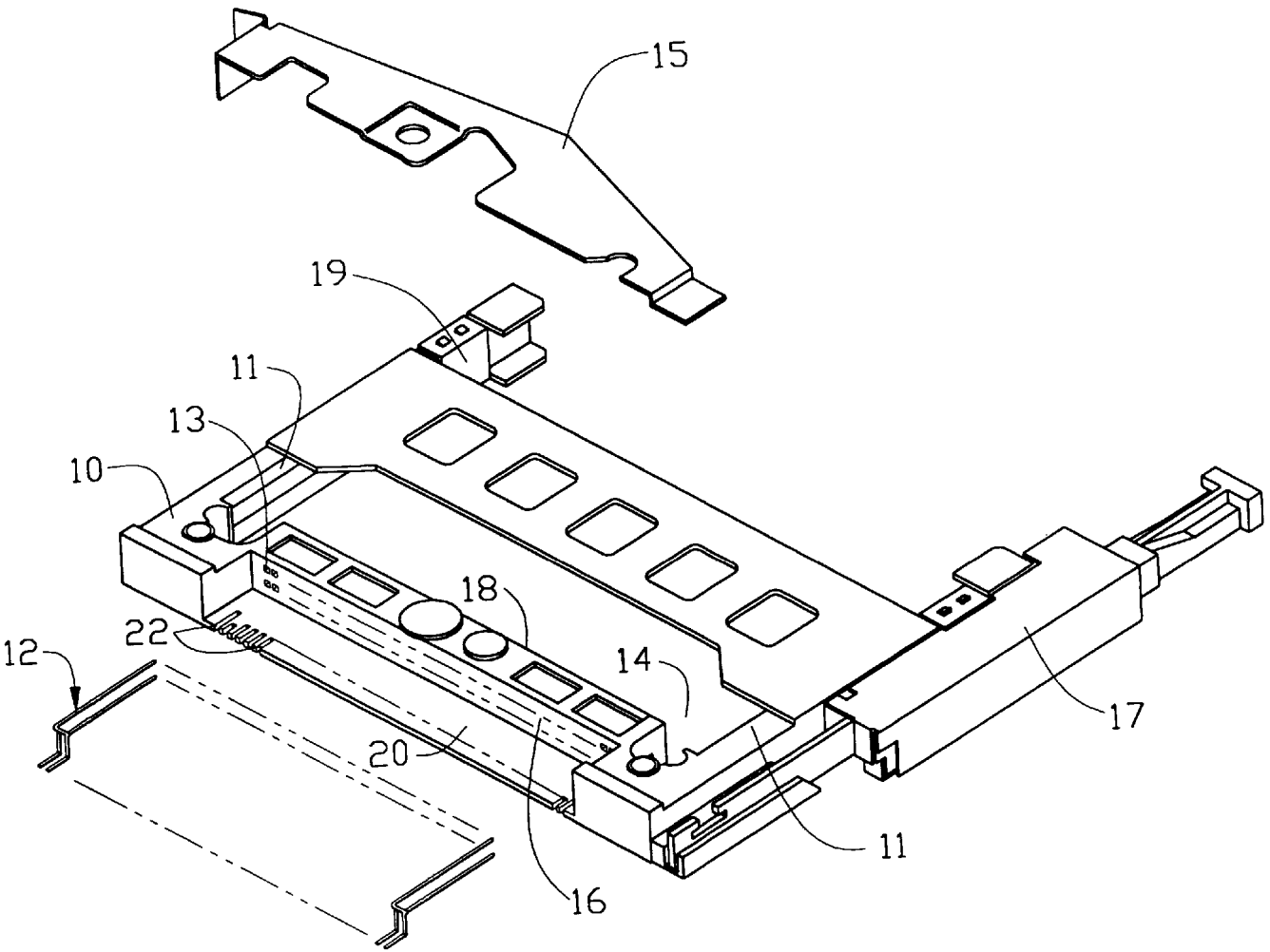
FIG. 1 is an exploded view of an IC card connector of the present invention.
Figure 2:
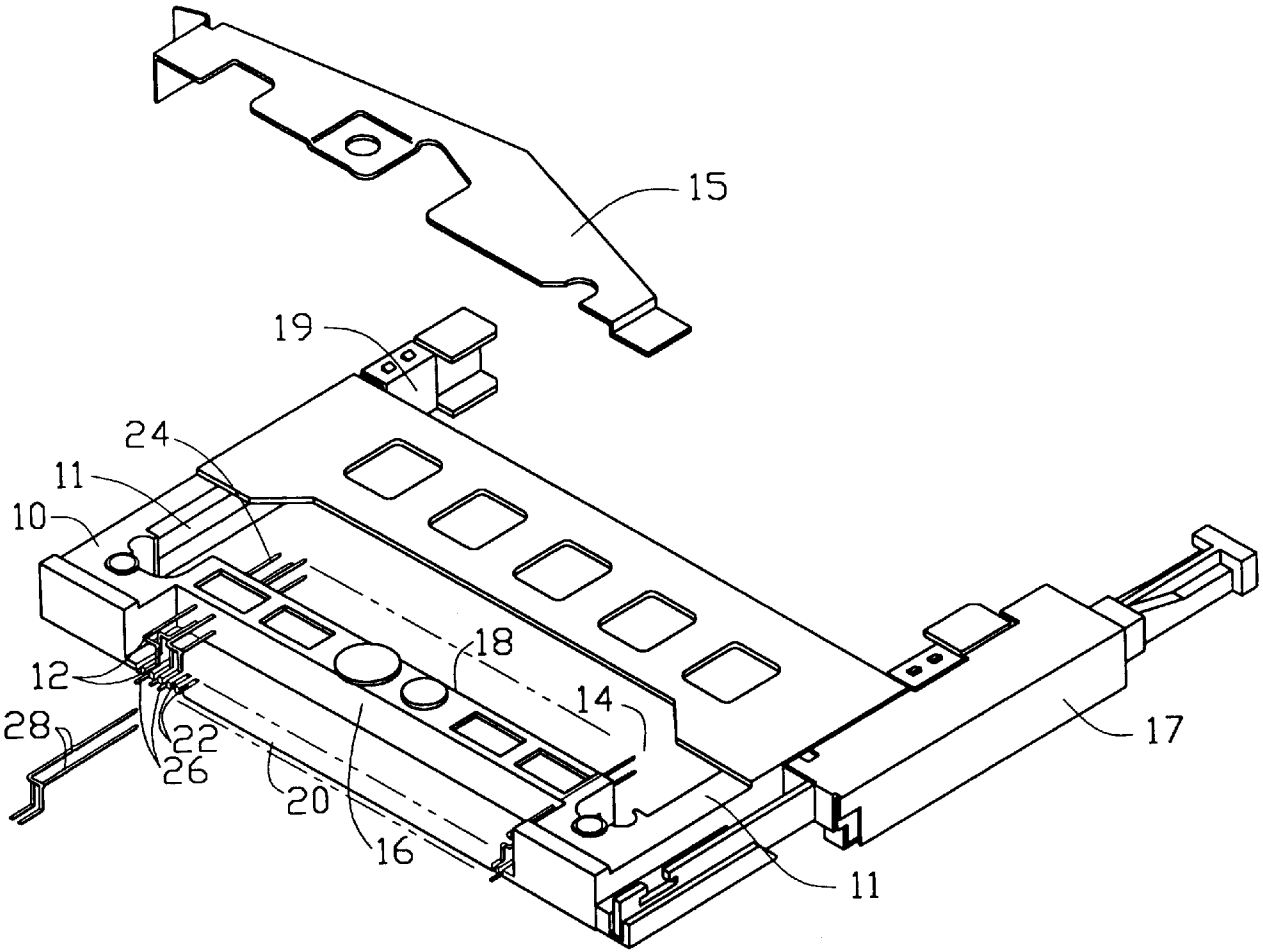
FIG. 2 is a partially assembled view of FIG. 1.
Figure 4:
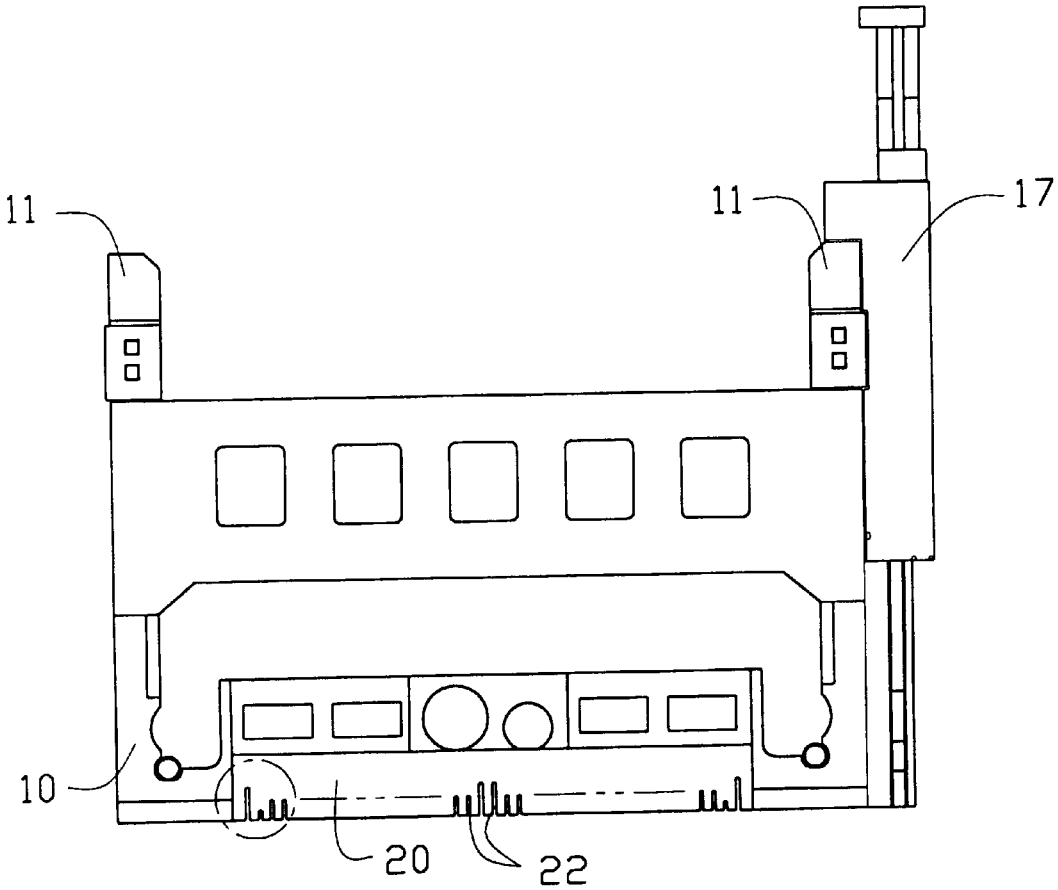
FIG. 4 is a top view of the IC card connector of the present invention.
Figure 5:
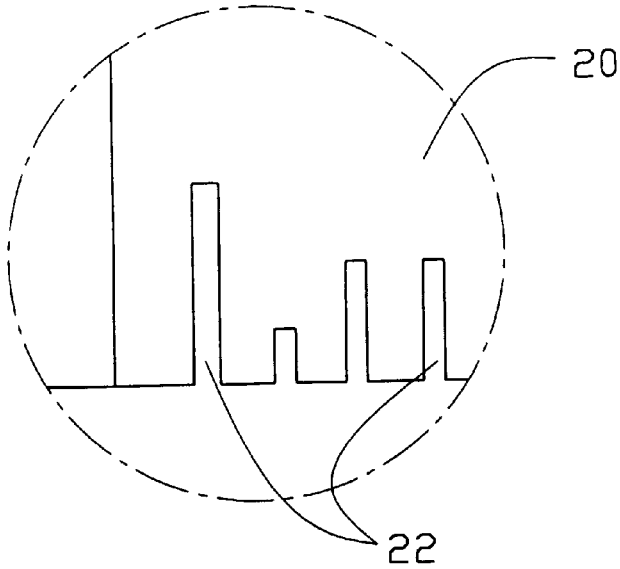
FIG. 5 is an enlarged view of notches of the present invention.

Referring to FIGS. 1 and 2, an IC card connector of the present invention includes an elongate insulative housing 10 having two arrays of terminal passageways 13 therethrough and two arrays of terminals 12 retained in the passageways 13. The housing 10 forms a pair of leading portions 11 at opposite ends thereof. A space 14 is defined between the leading portions 11 for receiving an IC card (not shown). The housing 10 defines a mating face 18 facing the space 14 and a mounting face 16 opposite the mating face 18. Two arrays of passageways 13 are defined through the mating face 18 and the mounting face 16 for securely retaining the corresponding terminals 12 therein. A spacer 20 extends from the mounting face 16 and defines a plurality of notches 22 with different predetermined depths on a front edge thereof opposite the mounting face 16 (FIGS. 4 and 5).

Figure 6:
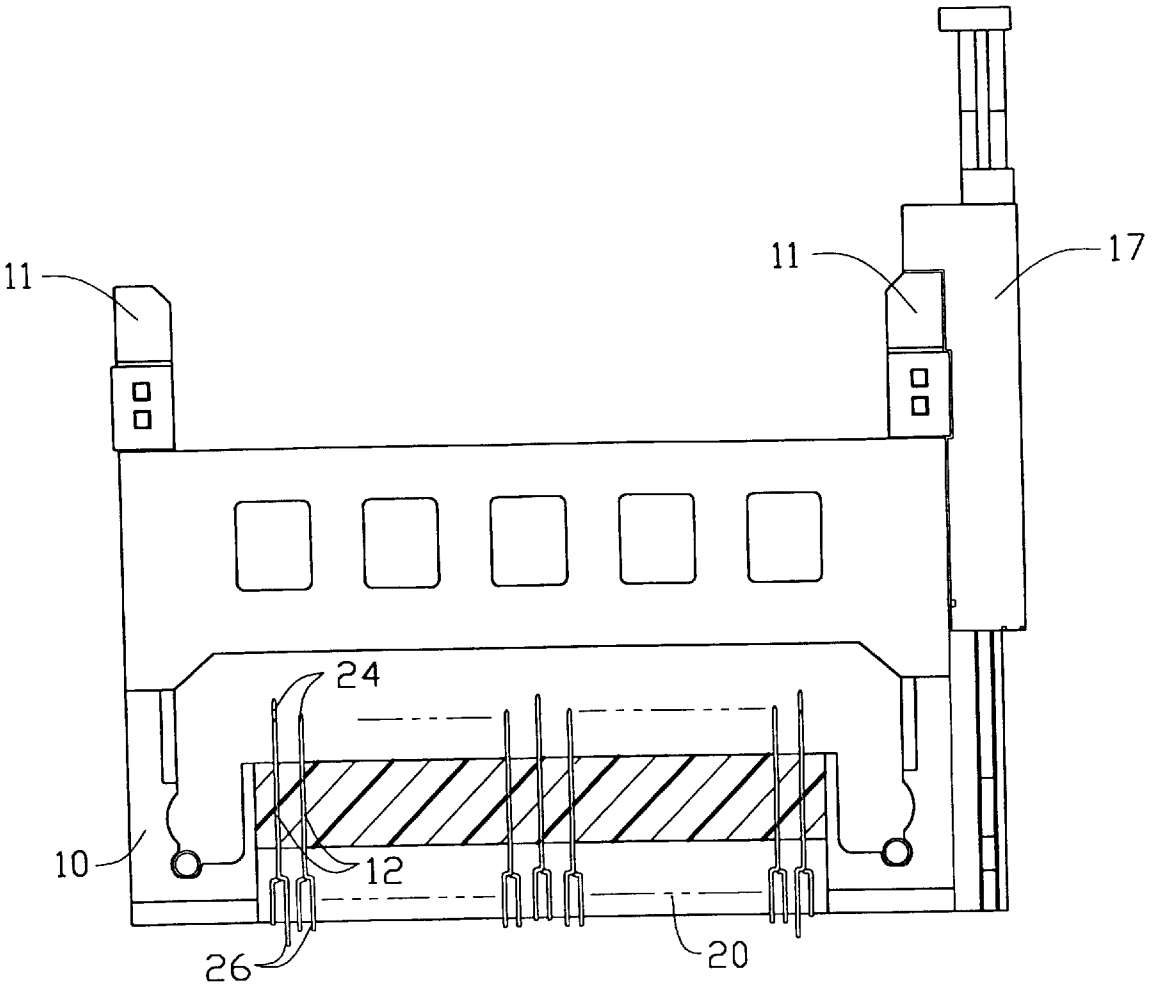
FIG. 6 is a cross-sectional view of the IC card connector of the present invention.

Each terminal 12 forms a mating portion 24 and a mounting portion 26 angled from the mating portion 24. The mating portion 24 is received in the corresponding passageway 13 and extends beyond the mating face 18 for engaging the IC card. Locking barbs 28 (FIGS. 3A and 3B) are formed on the mating portion 24 for securely retaining the mating portion 24 in the passageway 13 (FIG. 6). The mounting portion 26 forms a solder end which is secured in the corresponding notch 22 of the spacer 20 by abutting against an end of the notch 22 and soldered to a circuit board (not shown) by surface mount technology. All the terminals 12 in the same array have the same dimension. When the mounting portion 26 of each terminal 12 is secured in the notch 22, the mating portion 24 having a predetermined protruding length extends beyond the mating face 18 for signal transmission or grounding (for electrical connections with the inserted IC card). A middle portion between the mating portion 24 and the mounting portion 26 is transversely bent to align the mounting portion 26 with the corresponding notch 22.

In addition, the IC card connector includes an ejector mechanism having an actuator 15 pivotally mounted to one side of the housing 10 and an elongate push rod 17 mounted to an opposite side of the housing 10. The push rod 17 is pivotally engaged with the actuator 15. When the push rod 17 is activated, the actuator 15 is driven to eject an inserted IC card. A grounding plate 19 is mounted on an inner side of each leading portion 11 for contacting corresponding portions of the inserted IC card to provide a grounding path for charges accumulated on a surface of the IC card.

Figure 3B:
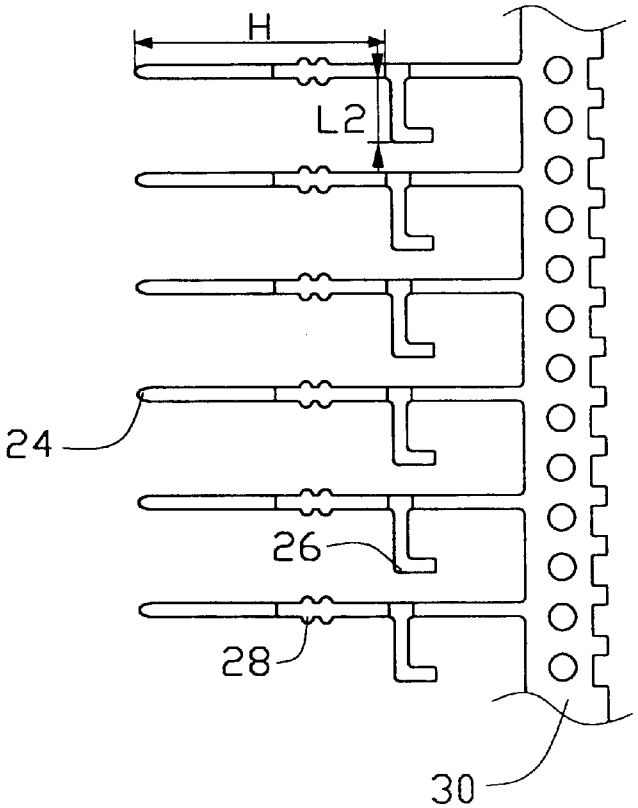
FIG. 3B is a planar view of terminals attached to a carrier in accordance with the present invention.
Figure 3A:
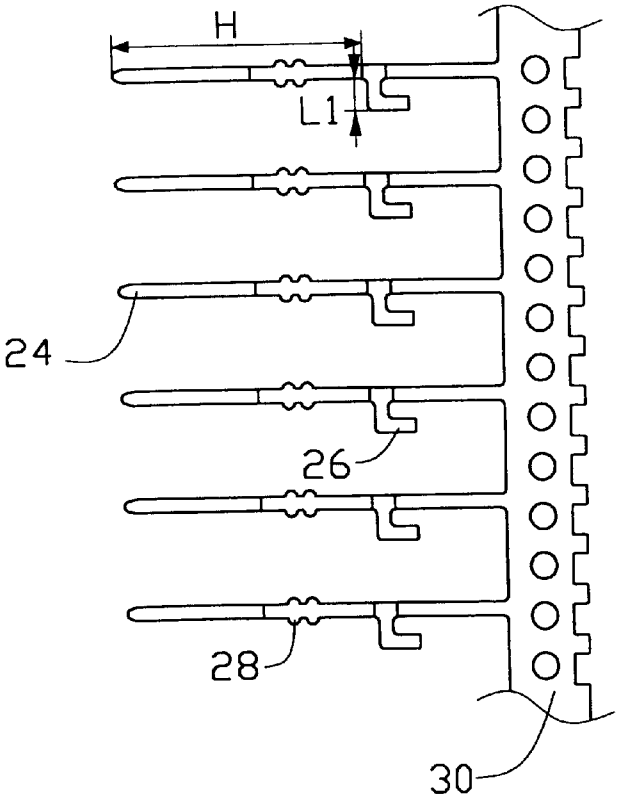
FIG. 3A is a planar view of lower terminals attached to a carrier in accordance with the present invention.

Referring to FIGS. 3A and 3B, each terminal 12 is unitarily stamped to have a mating portion 24, a mounting portion 26 angled from the mating portion 24 and a linking portion (not labeled) connecting the mating portion 24 and the mounting portion 26. The linking portions are manufactured with dimensions L1 and L2 for the upper and lower arrays of the terminals 12, respectively. The mating portions 24 are manufactured with the same dimension H. For the requirement of the two arrays of upper and lower terminals, only portions of a mold need to be changed. Thus, a mold with a carrier 30 is adapted to manufacture terminals with the same length but different heights, which is both time and cost efficient. Before mounting of the terminals 12 to the housing 10, a middle portion between the mating portion 24 and the mounting portion 26 of each terminal 12 is transversely bent to align the mounting portion 26 with the corresponding notch 22 of the spacer 20 (FIG. 6). In addition, the mounting portion 24 of each terminal 12 is stamped whereby the mating portions 24 can be ensured to lie in the same plane, which improves the soldering quality of the terminals 12 to the circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An IC card connector comprising:

an insulative housing having a mating face and a mounting face opposite said mating face and a plurality of terminal passageways extending through the housing from the mating face and the mounting face, a pair of leading portions extending rearwardly from the housing and defining a space therebetween;

a plurality of terminals received in the passageways, each terminal forming a mating portion extending beyond the mating face of the housing and into the space for engaging with an inserted IC card, and a mounting portion opposite the mating portion, the mounting portion having a solder end, the lengths of the mating portions of the terminals substantially being the same; and an elongate spacer integrally molded with and extending from the mounting face of the housing and defining a plurality of notches having different predetermined depths and being parallel to the corresponding passageways, each notch being aligned with and receiving the solder end of the corresponding terminal, the solder end of each terminal abutting against an end of a corresponding notch of the spacer, and one notch receiving only one terminal therein, whereby the mating portions of the terminals positioned in the notches with longer depths project beyond the mating face of the housing at pre-designated distances which are longer than those of the mating portions of other terminals positioned in the notches with shorter depths.

2. The IC card connector as claimed in claim 1, wherein said notches are defined in a front edge of the spacer.

3. The IC card connector as claimed in claim 1, wherein a portion between the mating portion and the mounting portion of each terminal is transversely bent to align the solder end of the mounting portion with the notch of the spacer.

4. The IC card connector as claimed in claim 1, wherein the mating portion of each terminal forms a locking barb for securely retaining the terminal in the corresponding passageway of the housing.

* * * * *